US005104624A

United States Patent [19]

Labriola

[11] Patent Number: 5,104,624

[45] Date of Patent: Apr. 14, 1992

[54] PIPETTER

[75] Inventor: Anthony M. Labriola, Woburn, Mass.

[73] Assignee: Costar Corporation, Cambridge, Mass.

[21] Appl. No.: 682,878

[22] Filed: Apr. 8, 1991

Related U.S. Application Data

[63] Continuation of Ser. No. 424,408, Oct. 20, 1989, abandoned.

[51] Int. Cl.[5] ..... B01L 3/02

[52] U.S. Cl. ..... 422/100; 73/864.13; 73/864.14; 73/864.16; 73/864.18; 141/25; 141/27

[58] Field of Search ..... 422/100; 73/864.11, 73/864.13, 864.14, 864.16, 864.18; 141/25, 27

[56] References Cited

U.S. PATENT DOCUMENTS

| | | | |
|---|---|---|---|
| Re. 27,637 | 5/1973 | Roach | 73/425.6 |
| 3,013,435 | 12/1961 | Rodrigues, Jr. | 73/425.6 |
| 3,327,900 | 6/1967 | Goda | 222/43 |
| 3,343,539 | 9/1967 | Moorhouse | 128/234 |
| 3,498,135 | 11/1968 | Seitz et al. | 73/425.6 |
| 3,613,952 | 10/1971 | Gilmont et al. | 222/43 |
| 3,766,785 | 10/1973 | Smernoff | 73/425.6 |
| 3,786,683 | 1/1974 | Berman et al. | 73/425.4 |
| 3,827,305 | 8/1974 | Gilson et al. | 73/425.6 |
| 3,853,012 | 12/1974 | Scordato et al. | 73/425.6 |
| 3,882,729 | 5/1975 | Roach | 73/425.6 |
| 3,905,232 | 9/1975 | Knute | 73/362 |
| 3,918,308 | 11/1975 | Reed | 73/425.6 |
| 3,991,617 | 11/1976 | d'Autry | 73/425.4 |
| 4,009,611 | 3/1977 | Koffer et al. | 73/425.6 |
| 4,023,716 | 5/1977 | Shapiro | 222/309 |
| 4,054,062 | 10/1977 | Branham | 73/864.14 |
| 4,084,730 | 4/1978 | Franke et al. | 222/309 |
| 4,151,750 | 5/1979 | Suovaniemi et al. | 73/864.14 |
| 4,154,108 | 5/1979 | Vollinger et al. | 73/425.6 |
| 4,250,755 | 1/1981 | Kenney | 73/425.6 |
| 4,283,950 | 8/1981 | Tervamaki | 422/100 X |
| 4,362,063 | 12/1982 | d'Autry | 73/864.1 |
| 4,909,991 | 3/1990 | Oshikubo | 422/100 |

*Primary Examiner*—Lynn M. Kummert
*Attorney, Agent, or Firm*—Wolf, Greenfield & Sacks

[57] ABSTRACT

A hand-held, manually operated pipetter having a variable volume controlled by a rotating spindle and adjusting screw that control the position of a stop which limits the upper end of the stroke of the pipetter piston. The lower end of the stroke is controlled by a movable stop urged to a first position by a blow-out spring which may be overcome with additional force applied to the pipetter piston when the lower stop is engaged. The pipetter also includes a stripper which surrounds the tip holder and which is actuated by a rod movable in the body of the pipetter along a path parallel to the path of the pipetter piston. The pipetter piston and the stripper rod are controlled by separate actuators which may readily be engaged by the thumb of the hand which holds the body of the device.

26 Claims, 7 Drawing Sheets

58
96
22
56
94
28
72
154
30
170
24
172
70
20
74
156
5
164
86
92
88
84
152
90
162
53
76
160
112
166
52
158
6
6
210
102
82
80
150
114
48
110
116
208
120'
120'
206
120
54
8
8
200
220
204
222
202
176
32
178
46
188
36
180
122
179
44
34
50
42
26
181
5
60
182

20
86
84
88
92
90
112
76
53
52
102
82
100
80
104
110
114
116
48
120
54
220
220
222
222
122
223
32
46
36
34
38
40
126
42
44
50
181
26

58
56
76
150
82
80
112
48
114
120
52
180
122
50
181
60
T
61
W 58
56
170
172
164
76
112
82
80
48
114
52
122
50
181
60
T
61
W 58
56
94
170
172
154
72
70
152
162
76
112
82
80
114
48
52
150
122
34
50
181
60
182
26
T

PIPETTER

This application is a continuation of application Ser. No. 07/424,408, filed Oct. 20, 1989, now abandoned.

INTRODUCTION

This invention relates to pipetters used to transfer fluid from one location to another and more particularly comprises a new and improved manually operated, hand held pipetter.

There are at the present time many single channeled pipetters on the market. These devices are widely used in clinics and laboratories to transfer liquids in very small volumes from one location to another such as from a reservoir containing larger volumes of the liquid to very small wells and plates in which tests and experiments are conducted.

The principle object of the present invention is to devise such a device which is free of expensive specially machined metal parts and which may be easily assembled and disassembled so as to reduce the manufacturing costs of the device and enable the user to assemble and disassemble it conveniently for cleaning and autoclaving.

Another important object of the present invention is to provide a pipetter which may easily and conveniently be held in one hand and which may be adjusted, locked, and actuated by the hand which holds it.

Another important object of the present invention is to provide a variable volume pipetter which may be easily and conveniently locked to repeatedly transfer a selected volume and which will not thereafter be accidentally unlocked so as to allow the volume to be altered. Consequently, the device provides a pipetter with reliable repeatability.

Another important object of the present invention is to provide a vernier scale in the volume adjustment assembly, which is convenient to use and easy to read and which does not interfere with the use of the device.

To accomplish these and other objects, the pipetter of the present invention comprises a elongated body adapted to be held in one hand with the palm and fingers encircling it. An adjusting screw is mounted in the body and extends through a major portion of its length, and the adjusting screw is externally threaded. A tip holder is mounted on the body in alignment with the adjusting screw and both have internal passages which extend axially in the body and together form a continuous passage. A pipetter piston is mounted in the adjusting screw, and extends into the tip holder. A thumb actuator connected to the pipetter piston extends above the body and is positioned to be actuated by the thumb as the body is held in the palm and four fingers. A spindle rotatable on the adjusting screw carries a stop which controls the metering of the pipetter. By rotating the spindle, the stop is moved so as to vary the length of the stroke of the piston and thus adjust the quantity of liquid drawn into the device. A vernier is provided on the spindle which may be read through a window in the body. The window also affords access to the spindle so that it may be turned. A slide lock is mounted on the body controlled by a finger grip exposed above the lower end of the body. The lock is positioned to engage the spindle and bind against it so as to prevent spindle rotation when the lock slide is in the operative position. A stripper surrounds the tip holder and extends substantially to the lower end thereof. An actuator for the stripper is mounted in the body, and the stripper and actuator are connected to one another just below the lower end of the body. A thumb actuated button is carried on the top end of the actuator so as to be selectively operated by the user when a removable tip is to be stripped from the holder.

These and other objects and features of the present invention will be better understood and appreciated from the following detailed description of one embodiment thereof, selected for purposes of illustration and shown in the accompanying drawing, in which:

DETAILED SPECIFICATION

Figure 1:
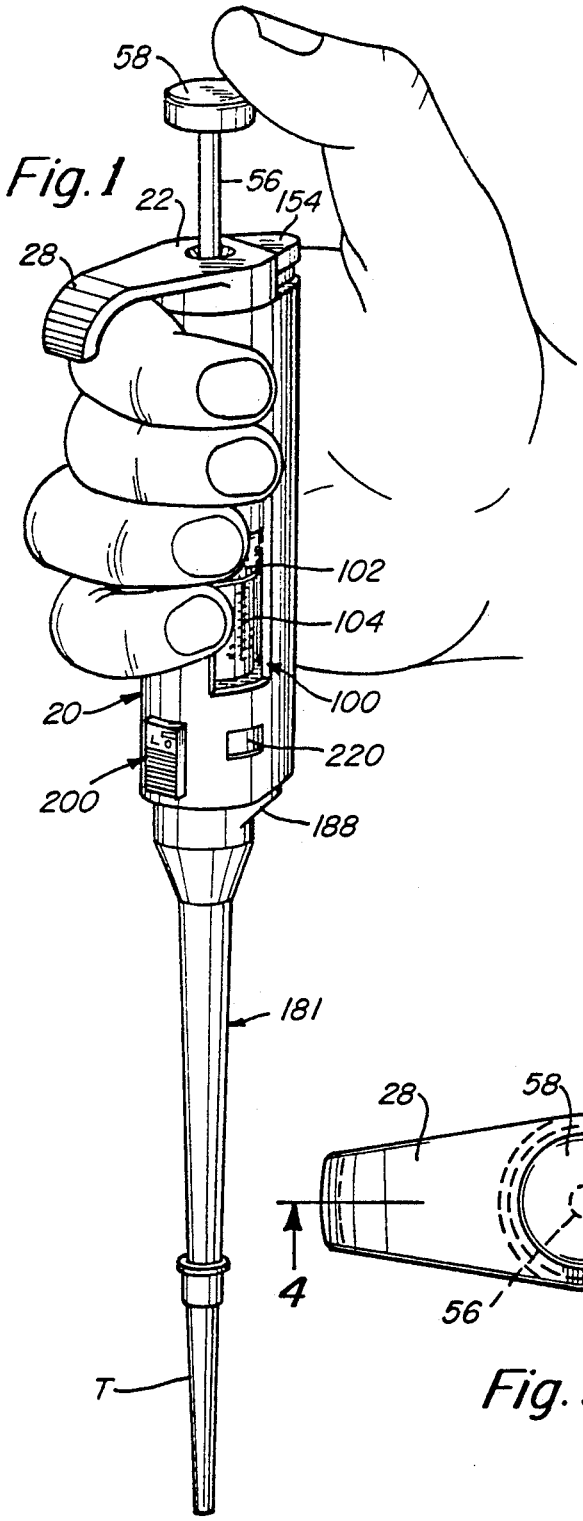
FIG. 1 is a perspective view of a pipetter constructed in accordance with this invention and shown as it may be held in the hand of a user.
Figure 2:
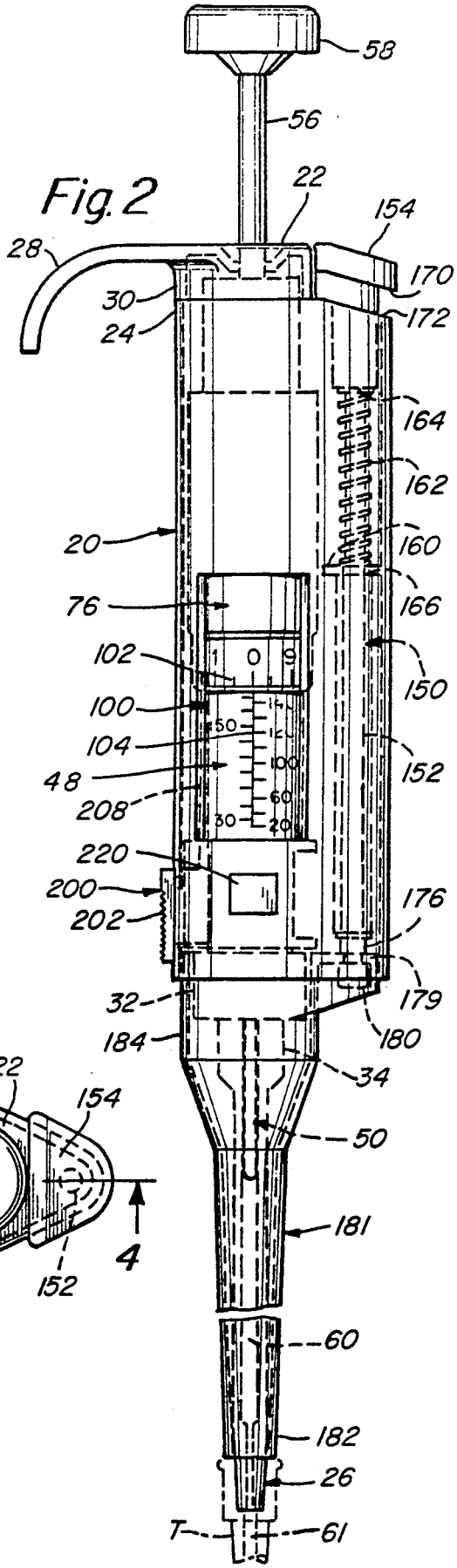
FIG. 2 is an enlarged front elevation view of the pipetter shown in FIG. 1.
Figure 3:
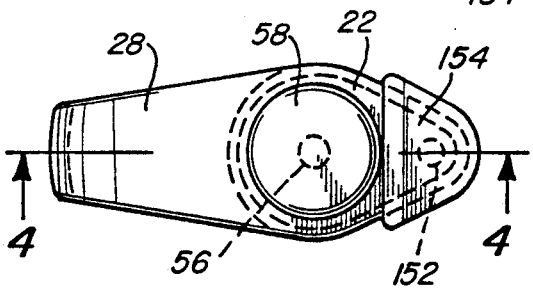
FIG. 3 is a top view of the pipetter.

The pipetter of the present invention has a generally tubular body 20 carrying a cap 22 at its upper end 24 and a tip holder 26 at its bottom end (see FIGS. 1 and 2). The body 20 houses both the mechanism for performing the pipetting action and the stripping mechanism for removing a disposable tip T from the holder In this description, the orientation of the parts of the pipetter are described with respect to the normal, generally vertical position of the instrument in use.

The cap 22 is ultrasonically welded or otherwise permanently secured to the body 20 and has a curved flange 28 which normally engages the index finger of the user's hand when the instrument is held in the operative position with the operator's thumb positioned to actuate either of the two pistons in the device, which are described more fully below. The normal gripping position of the pipetter is suggested in the drawings in FIG. 1. The attachment between the cap and the body is facilitated by the cap collar 30 which registers with the upper end 24 of the body 20 (see FIG. 4).

Figure 4:
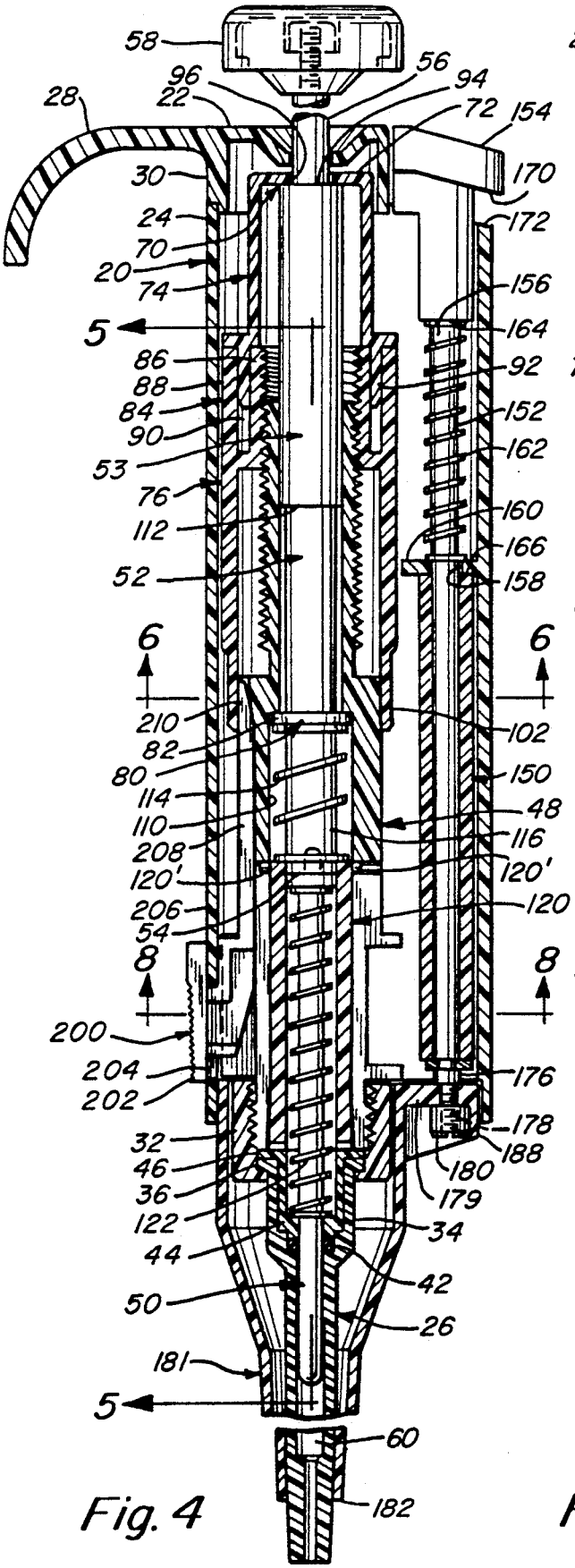
FIG. 4 is a longitudinal cross sectional view of the pipetter taken along section line 4—4 in FIG. 3.
Figure 5:
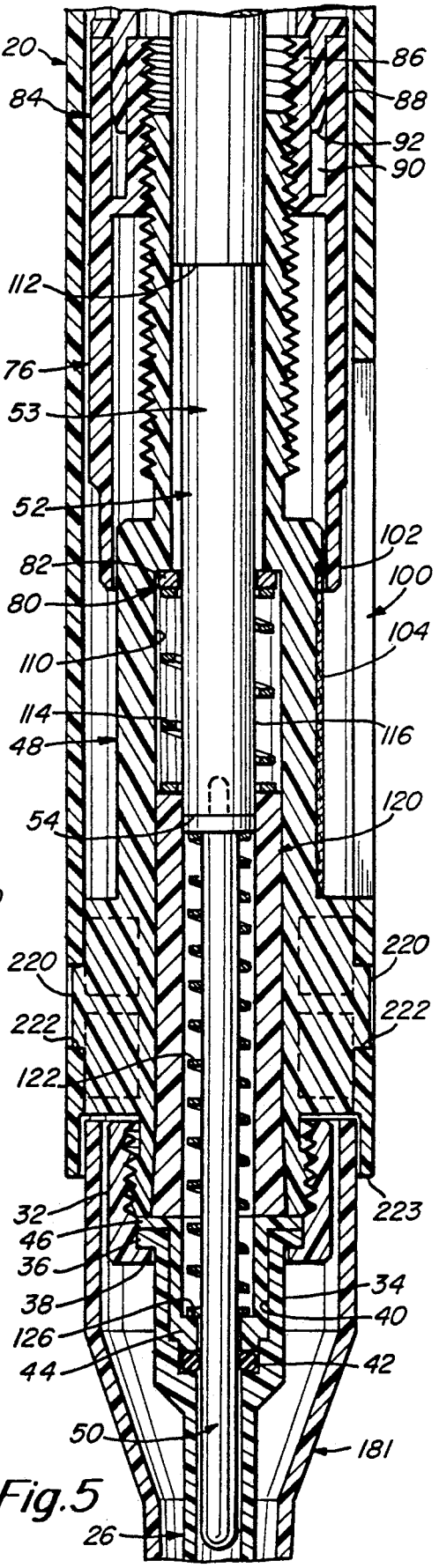
FIG. 5 is an enlarged fragmentary cross sectional view of the pipetter taken along section line 5—5 in FIG. 4.

As is shown in FIGS. 4 and 5, the tip holder 26 at its upper end 34 has an enlarged diameter, and at its extreme upper end carries an outwardly extending flange 36 which is engaged by the lip 38 on the lower end of locknut 32. The cylindrical chamber 40 within the top end 34 of holder 26 carries an O-ring 42 held in place by an O-ring retainer 44 also disposed in the enlarged top end 34. The O-ring retainer 44 has an outwardly extending flange 46 at its top, which abuts against the flange 36 of the tip holder. The locknut 32 retains the subassembly comprising the O-ring retainer 44 and tip holder 26 on adjusting screw 48 that forms part of the metering assembly that is described in detail below.

Figure 12:
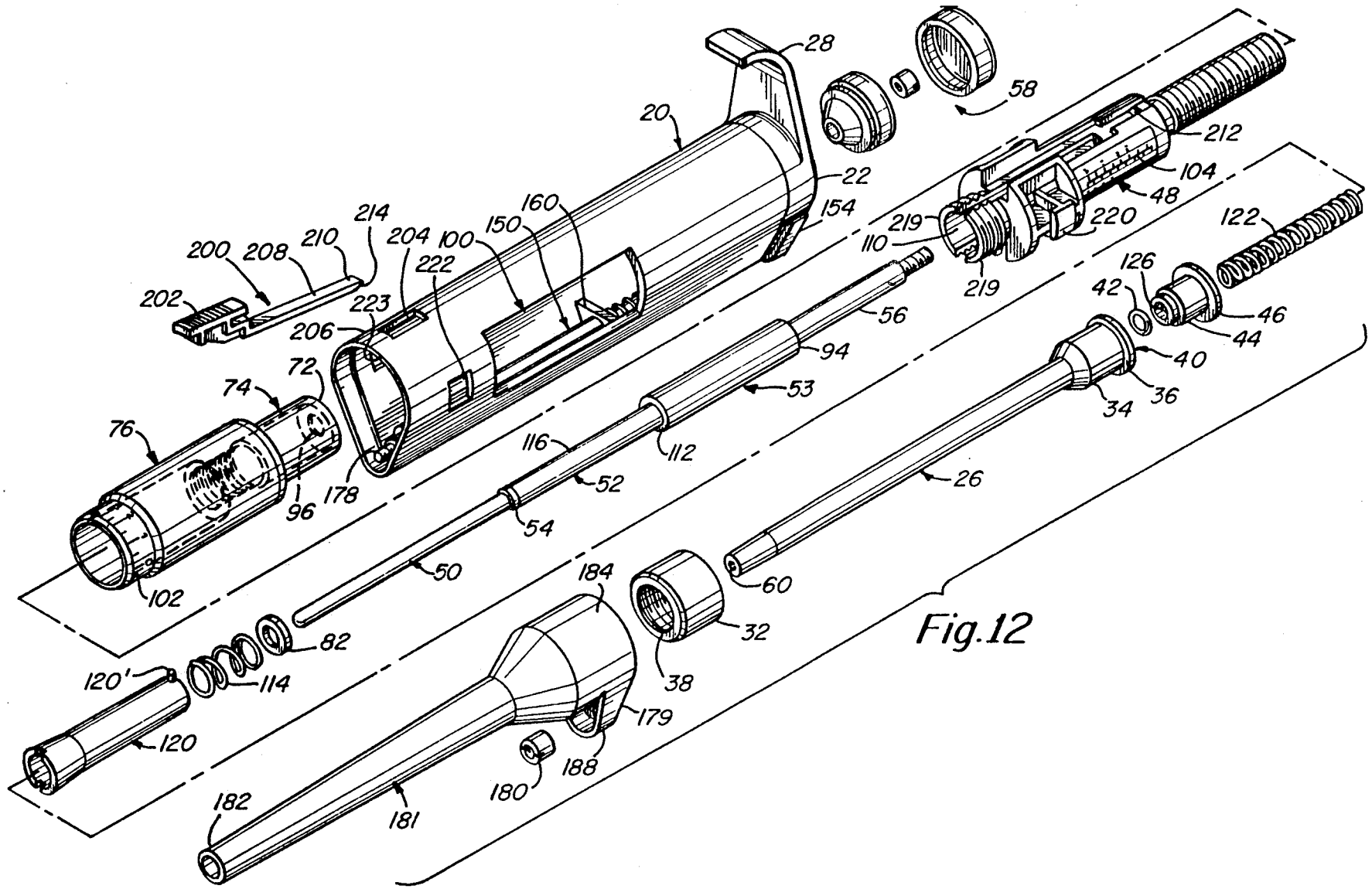
FIG. 12 is an exploded view of the pipetter showing the major components of the pipetter and suggesting how they are assembled together.

A piston 50 and guide rod 52 (hereinafter sometimes collectively called the pipetter piston 53) are coupled together at 54 and move reciprocally together within the body 20 and tip holder 26. The guide rod 52 at its upper end carries a stem 56 which, in turn, carries a plunger button 58 (see FIGS. 4 and 12). The plunger button 58 is positioned to be engaged by the thumb of the hand as suggested in FIG. 1 so as to move the pipetter piston 53 axially and downwardly in the body 20 and tip holder 26 when fluid is to be expelled from the cylindrical passage 60 of the tip holder 26 and the axial passage 61 in the disposable tip T.

The length of the vertical stroke of the pipetter piston 53 is controlled by two separate stops mounted in the body 20. The upper limit of the stroke of the pipetter piston is established by the adjustable stop 70 defined by the flange 72 of a spindle cap 74 which in turn is carried by a spindle 76. As is evident in FIGS. 4 and 5, the spindle 76 is threaded onto the adjusting screw 48 and moves axially on it when the spindle is rotated. The second stop 80 is established by a washer 82 which engages the shoulder 112 of the piston assembly 53.

In the illustrated embodiment of this invention the spindle cap 74 and spindle 76 are separately fabricated. The spindle 76 at its upper end 84 has inner and outer collars 86 and 88 which define an annular space 90 between them into which the collar 92 on the lower end of the spindle cap 74 extends (see FIG. 5). The two parts may be ultrasonically welded together or otherwise secured together so that they are permanently fixed to one another and move as a unit on the adjusting screw 48. The flange 72 of the spindle cap 74 lies above the shoulder 94 of the guide rod 52 and is provided with a small opening 96 at its center through which the stem 56 extends (see FIG. 4). Thus, the upward travel of the pipetter piston 53 is limited by engagement of the shoulder 94 on the guide rod 52 with the flange 72. The position of the flange may be varied by rotating spindle 76 on the adjusting screw 48.

As is described more fully below, the spindle 76 may be viewed within the body 20 of the pipetter through a window 100 (see FIG. 2), and the spindle carries a ring 102 with a vernier scale which cooperates with a scale 104 in the window 100. These calibrations are a measure of the volume of fluid to be drawn into the passage 61 in the tip T when the pipetter piston 53 is retracted, as is made clear below in connection with the description of the operation of the instrument.

The lower stop 80 disposed within the axial chamber 110 in adjusting screw 48 cooperates with the shoulder 112 formed in the guide rod 52 and which faces downwardly in the pipetter body 20. The washer 82 that comprises the stop is yieldably held in place by a blow out spring 114 which surrounds the reduced diameter section 11 of the guide rod extending downwardly from the shoulder 112 to the coupling 54 joining the lower end of the guide rod 52 and the piston 50. The blow out spring 114 bears against the upper face of a spring retainer 120 also mounted in the chamber 110 in adjusting screw 48. Thus, the lower stop 80 is yieldable, as the washer 82 may be moved downwardly against the bias of the spring 114 when engaged by the shoulder 112 as the spring 114 compresses. The spring retainer 120 is described in further detail below in connection with the assembling and disassembling of the pipetter.

Figure 10:
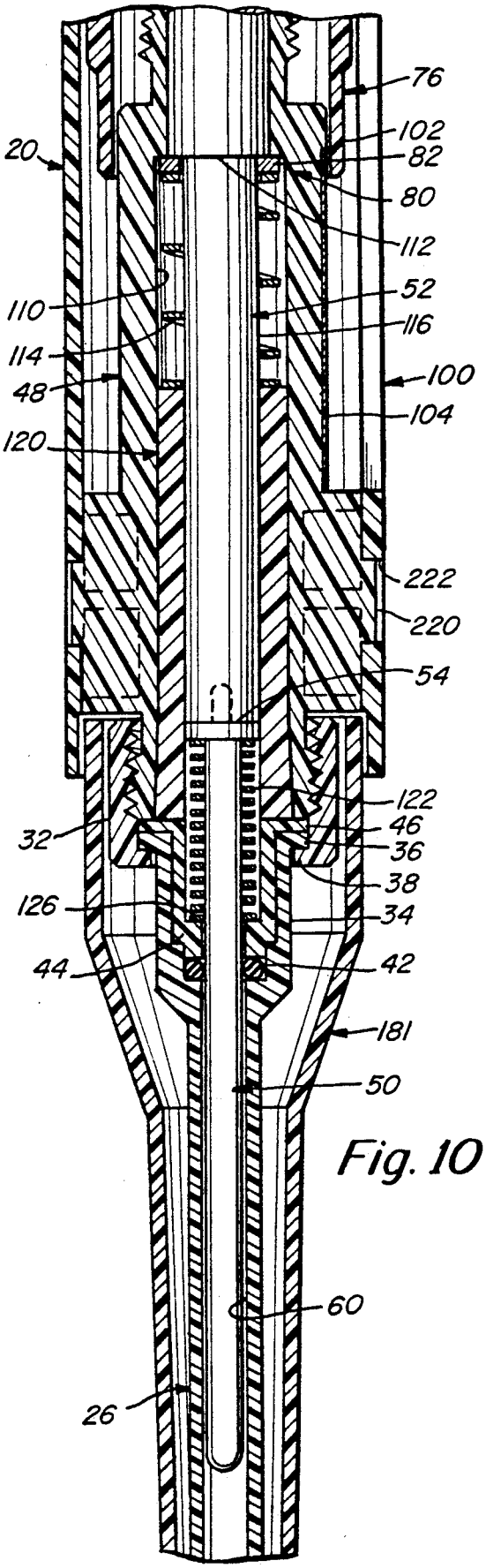
FIGS. 10 and 11 are fragmentary cross-sectional views similar to FIG. 5 but showing the pipetter piston in the partially and fully depressed positions, respectively.
Figure 11:
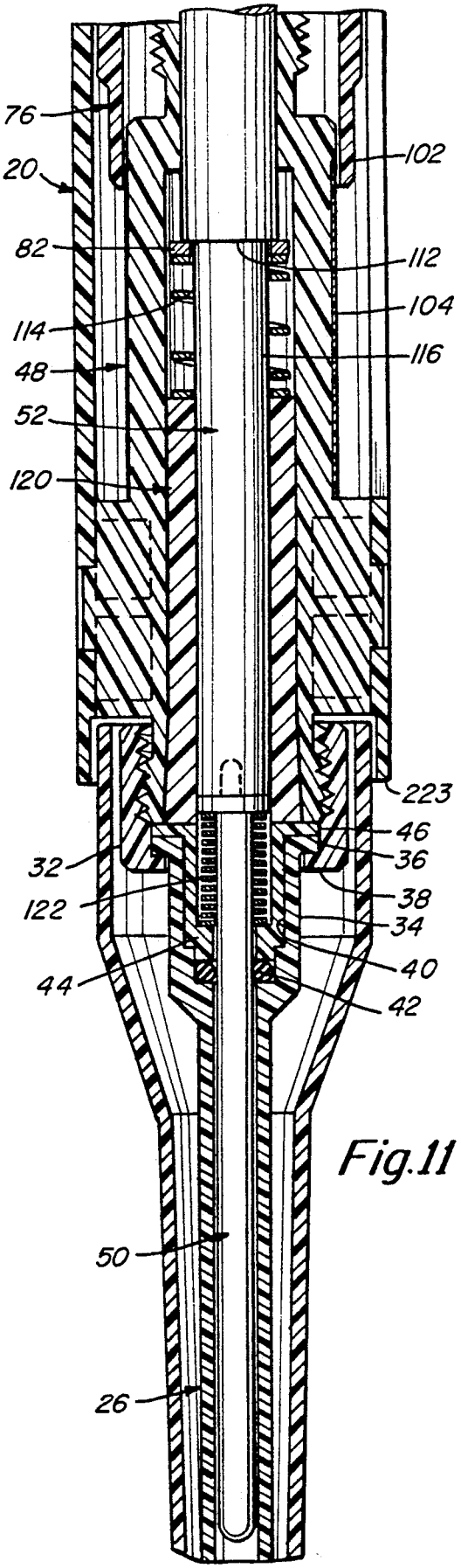

A second coil spring 122 surrounds the piston 50 and extends between the coupling 54 and a seat 126 formed in the lower end of the O-ring retainer 44 (see FIG. 5). The spring 122 serves as the main spring to yieldably oppose downward actuation of the pipetter piston 53. Any downward motion of the pipetter piston 53 causes the coil spring 122 to compress (see FIG. 10), and whenever the actuating button 58 is released the pipetter piston returns to the upper position shown in FIG. 2. During the initial movement of the pipetter piston 53, only the spring 122 is compressed and the resistance to actuation of the pipetter piston is essentially uniform throughout the major portion of the stroke established by the stops 70 and 80 and shoulders 94 and 112. When the shoulder 112 engages the yieldable stop 80 (as in FIG. 10), further forward motion of the pipetter piston 53 is permitted only by compression of the blow-out spring 114 and continued compression of the spring 122 (see FIG. 11). Thus, substantially more resistance is encountered during the blow-out function of the pipetter, and a very clear "feel" is sensed by the user when the principal portion of the stroke is completed.

A stripper assembly 150 is in part mounted within the body 20 and in part lies below the body and surrounds the tip holder 26. The stripper assembly 150 includes a stem 152 mounted for reciprocal motion within the housing 20 along a path parallel to the axis of the pipetter piston 53 (see FIG. 4). The rod 152 carries an actuating button 154 at its upper end 156, which may be conveniently actuated by the thumb of the hand which grips the body 20, as is evident in FIG. 1. The rod 152 is supported in an opening 158 in flange 160 formed as an integral part of the body 20. A compression spring 162 surrounds the upper portion of the rod 152 between the flange 160 and the lower end 164 of actuating button 154 and urges the rod upwardly in the body. The upward travel of the rod 152 is limited by the shoulder 166 formed on the rod and which engages the flange 160. The downward travel of the rod 150 is limited by engagement of the flange 170 of the actuating button 154 with the edge 172 of the body 20.

The lower end 176 of the rod 152 has a threaded stem 178 of reduced diameter, which extends through the flange 179 of a tubular stripper 181. The two are held in assembled relationship by the retaining nut 180.

The stripper 181 is tapered slightly in a downward direction so that its lower end 182 has an inner diameter which is only slightly greater than the outer diameter of the tip holder 26. The inner diameter of the stripper 181 increases in an upward direction and is significantly enlarged at its upper end 184 so as to surround the locknut 32. The strength of the stripper 181 at its upper end is enhanced by the rib 188 connected to the flange 179 at the location where the threaded stem 178 of the rod 152 extends through the flange.

It is apparent that when the actuating button 154 is depressed, the rod 152 moves downwardly and carries the stripper 181 with it. The movement of the stripper is guided by the tip holder 26 which it surrounds at its lower end. As the stripper 181 moves downwardly about the tip holder 26, the removable tip T carried on the end of the tip holder 26 will be forced off it and fall away from the pipetter.

Figure 6:
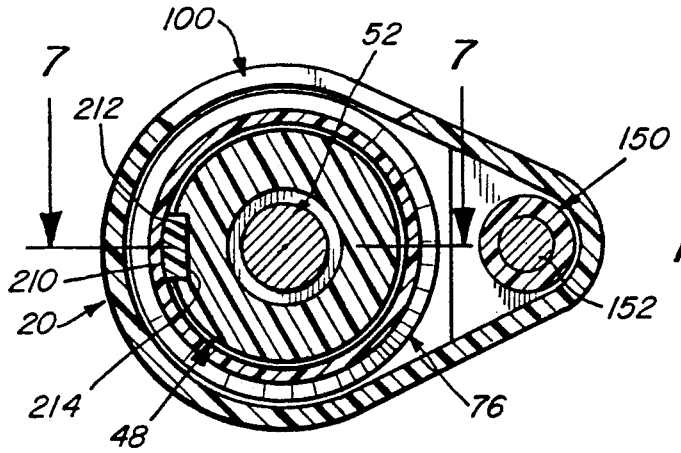
FIG. 6 is a cross-sectional view of the pipetter taken along section line 6—6 in FIG. 4 and showing the spindle of the device in the locked position.

From the foregoing description it is evident that rotation of the spindle 76 on the adjusting screw 48 varies the position of the upper stop 70 which limits the extent that the pipetter piston 53 may be retracted into the body 20. It is essential for accurate repeatability of the pipetter that any particular setting of the stop 70 be fixed when a series of liquid transfers is to be made by the device. In the present invention, the spindle may be locked against rotation on the adjusting screw by means of the lock slide 200 (see FIGS. 4, 6 and 7). The lock slide 200 mounted in body 20 is moved translationally in the body by means of a finger grip 202 mounted in slot 204 in the body wall 206. The finger grip has an upwardly extending arm 208 which extends along the outer surface of the adjusting screw 48 and into the lower end of the cylindrical spindle 76. The spindle 76 overlaps the upper end 210 of the arm 208 even in the uppermost position of the spindle as shown in FIG. 4.

Figure 7:
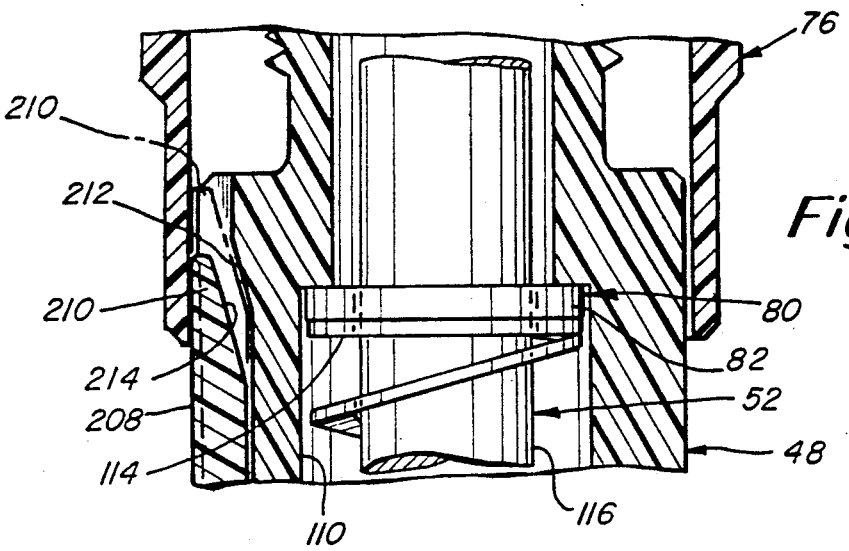
FIG. 7 is a cross-sectional view taken along section line 7—7 in FIG. 6 but showing the spindle of the pipetter in the unlocked position.
Figure 8:
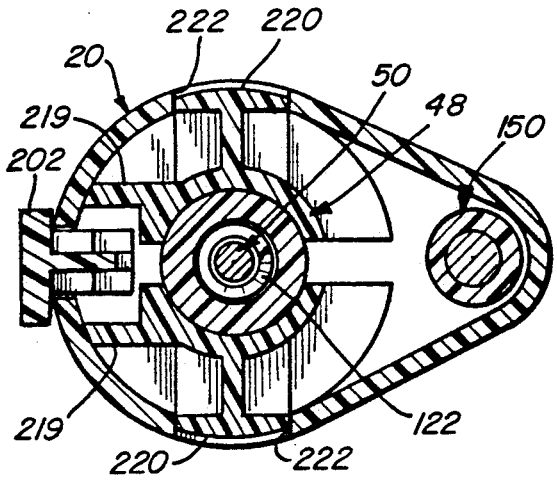
FIG. 8 is a cross-sectional view of the assembled pipetter taken along the section line 8—8 in FIG. 4.
Figure 9:
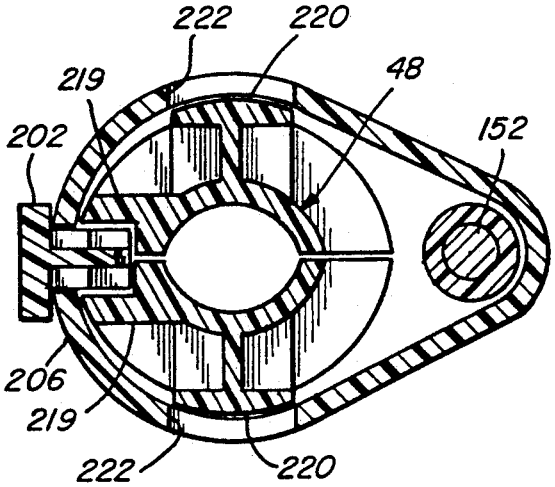
FIG. 9 is a cross-sectional view similar to FIG. 8 but showing the pipetter in the partially assembled form.

As is evident in FIG. 7 a ramp 212 is formed on the outer surface of the adjusting screw 48, which cooperates with a cam surface 214 on the inner face of the upper end 210 of arm 208. When the lock slide 200 is moved upwardly by actuation of the finger grip 202, the cam surface 214 rides upwardly on the ramp 212 causing the end 210 of the arm to bear against and bind on the inner surface of the spindle 76. The friction contact between the arm 208 and the inner surface of the spindle prevents the spindle from rotating and, therefore, the stop 70 remains in a fixed position to insure accurate, repetitive metering of the fluid. The spindle will not be moved again until the lock slide 200 is released.

As is shown in FIGS. 4, 8, 9 and 12, the adjusting screw 48 is split so as to divide its lower end into two finger like portions 219. Each finger portion carries an ear 220 on its outer surface that is sized to register with the openings 222 in the body wall 206. To mount the adjusting screw 48 in place, the finger portions 219 are squeezed together as in FIG. 9 so that they allow the ears 220 to clear the lower edge 223 of the body and snap into the openings 222. Once the adjusting screw 48 is mounted in the body 20 in that manner, the spring retainer 120 is inserted into the adjusting screw to prevent its finger portions 219 from collapsing toward one another and dislodging the ears 220 from the openings 222. It will be noted particularly in FIG. 12 that the lower end of the retainer 120 is tapered slightly, which causes the retainer to wedge in place within the screw 48 and rigidly support the barrel shape of screw. To disassemble the unit, the retainer 120 may be pulled from the adjusting screw, and the adjusting screw may then be removed from the body 20. The retainer 120, as described above, also locks in the blow-out spring 114 that biases the piston 53 upwardly in the assembly. The retainer 120 may have projections 120, at its upper end that register with slots in the adjusting screw to form a bayonet connection between the two, to prevent the retainer from accidentally falling from the assembly (see FIGS. 4 and 12).

As described briefly above, a portion of the spindle 76 is clearly visible through the window 100 in the body. The portion 102 viewable through the window carries a vernier scale which cooperates with the linear scale 104 on the window 100 so as to subdivide each unit of the linear scale into ten parts. The units, of course, are a function of the pitch of the adjusting screw and spindle, the diameter of the pipetter piston 53, etc.

Figure 13:
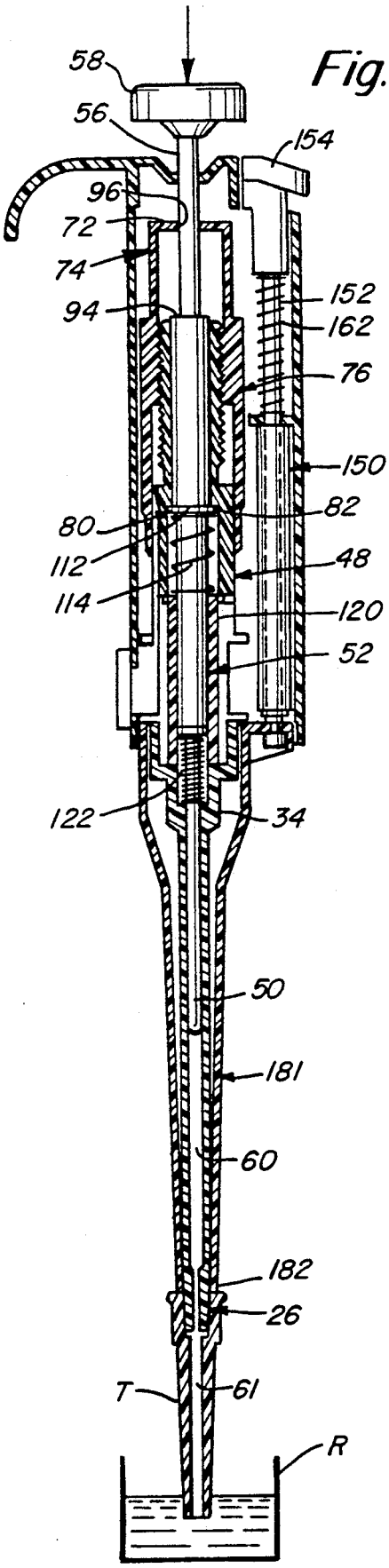
FIGS. 13-17 are diagrammatic views showing the sequence of steps through which the pipetter is operated to dispenser metered quantities of liquid and to strip a tip from the tip holder.
Figure 14:
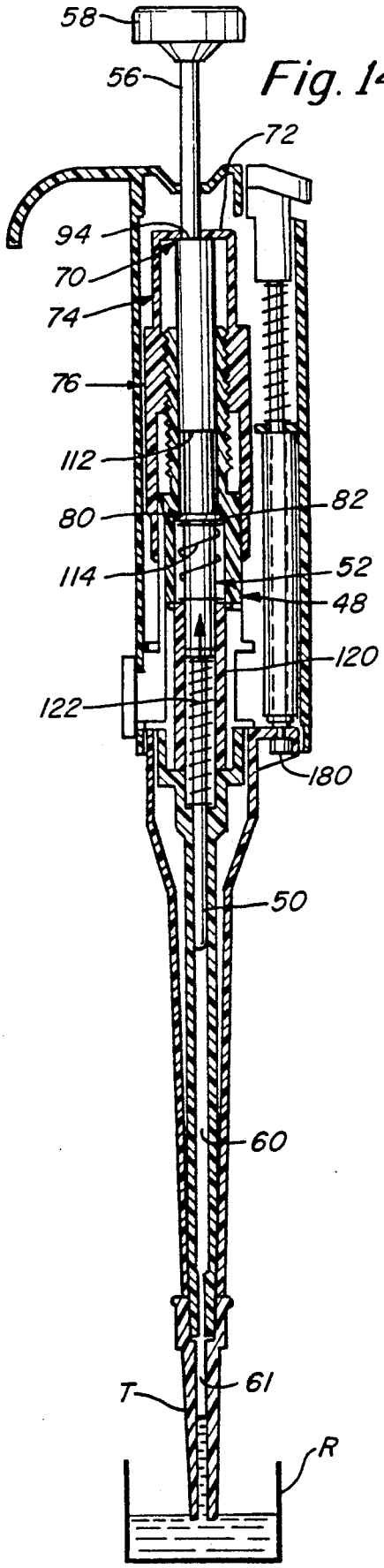
Figure 15:
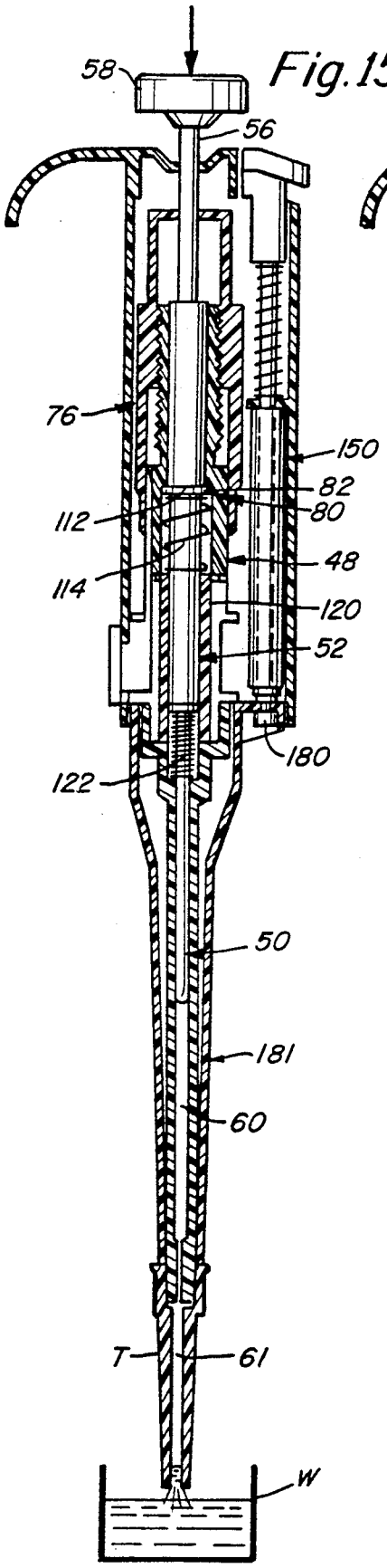
Figure 16:
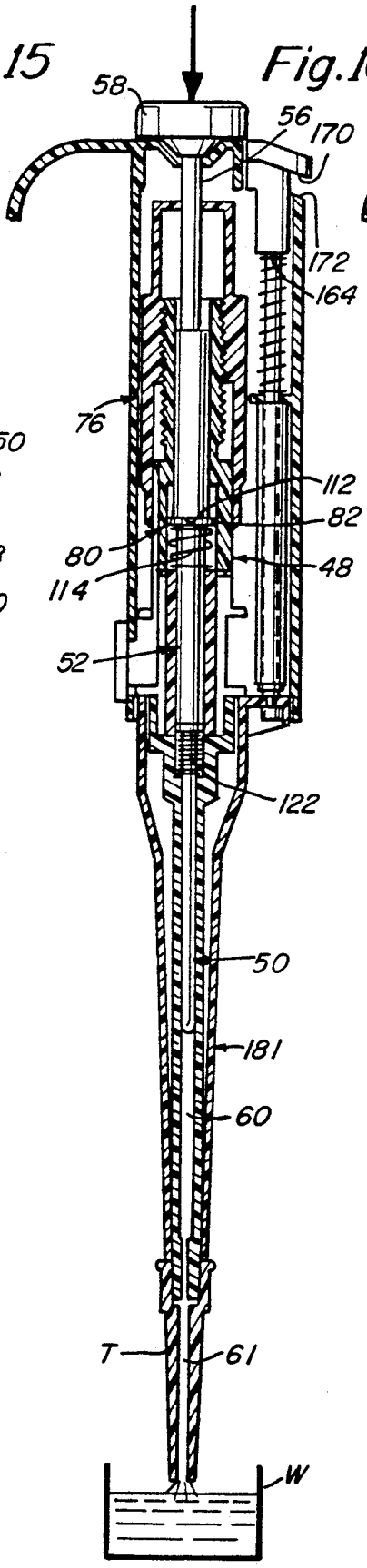
Figure 17:
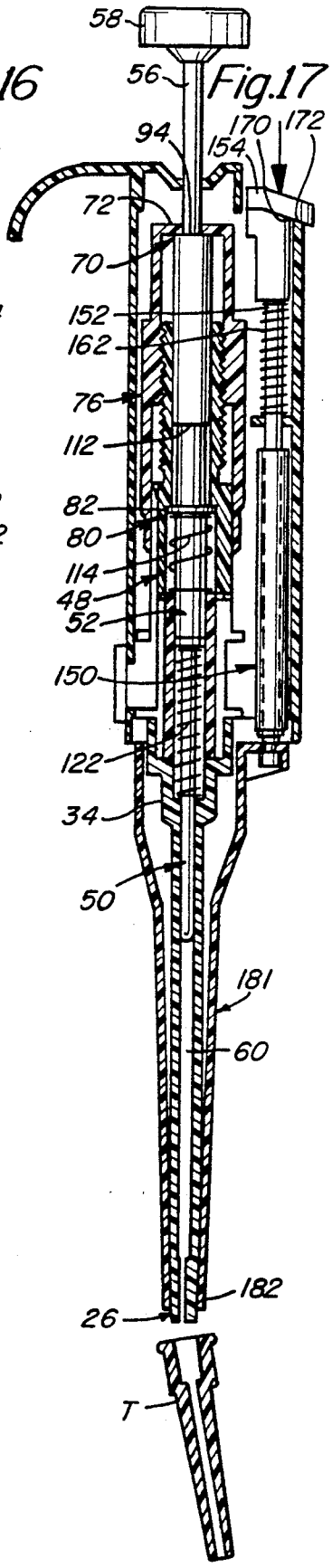

In use, the pipetter of the present invention operates as follows:

Assume a reservoir of fluid to be transferred and a plurality of wells to receive the transferred liquid are provided, and a selected volume to be transferred from the reservoir to each of the wells is known. The operator rotates the exposed portion of the spindle so as to set it to the selected position on the scale visible through the window. Assume also that a rack of disposable pipetter tips T is provided which enables the tip holder 26 to be inserted in the appropriate end of the disposable tip and frictionally engage it. With the tip in place on the holder 26, and the setting having been made with the spindle to position the stop 70, the operator moves the lock slide 200 upwardly with the finger grip 202 so that the upper end 210 of the arm 206 engages the inside of the spindle to hold it firmly against further rotation. The operator then depresses the button 58 carried by the spindle piston 53 until the shoulder 112 engages the stop 80. This position is shown in FIG. 13. Engagement of the stop by the shoulder 112 is readily sensed as significant additional resistance is encountered at that point because of the blow out spring 114. With the pipetter piston 53 in that position, the tip T is placed in the reservoir R with its lower end submerged in the liquid, and the button 58 is thereupon released allowing the pipetter piston 53 to rise under the influence of the spring 114 until the shoulder 94 of the piston engages the flange 72 as shown in FIG. 14. This action causes liquid to be drawn into the tip T in the volume set on the vernier scale. The pipetter is next positioned with the tip T aligned with the open end of the well W to which the liquid is to be transferred, and the operator again depresses the button 58 causing the pipetter piston to move downwardly. The pressure in the passage 60 in the tip holder and the passage 61 in the tip T causes the liquid in tip T to be discharged into the well. Essentially complete discharge occurs when the shoulder 112 again engages the stop 80 as in FIG. 15. However, to ensure total discharge of the liquid in the pipetter, the operator depresses the button 58 beyond that point, which causes the piston to move further downwardly, and washer 82 slides downwardly and compresses the blow out spring 114 as in FIG. 16. This action ensure the complete discharge of fluid from the pipetter. With the pipetter tip T removed from the well the operator then need merely release the button 58, and the main spring 122 of the metering assembly along with the blow-out spring 114 will return the pipetter piston to the fully retracted position shown in FIG. 2. If the same amount of fluid is to be transferred to yet another well, the foregoing procedure may be repeated If the tip T is to be removed, the operator need only press the button 154 and move the rod 152 against the bias of spring 162 until the flange 170 of the button engages the end 172 of the body 20. This action will cause the stripper 181 to move downwardly on the tip holder and cause the lower end 182 of the stripper to engage the tip T and force it off the holder 26 as suggested in FIG. 17.

From the foregoing description many of the advantages of the present invention will be apparent. For example, the pipetter of the present invention may very quickly and easily be adjusted to vary the volume of liquid drawn into the device upon actuation of the button 58. The adjustment is made simply by turning the spindle which is exposed through the window 100. Simply by spinning the spindle 76, the top stop 70 may be positioned so as to cause the pipetter piston to draw in the desired volume of liquid when the pipetter piston is depressed and then released. The vernier scale visible in the window enables the user to quickly set the stop to provide the desired metering. While the spindle is very easily turned, it may quickly and firmly be locked in any set position by means of the lock slide 200. By moving the slide upwardly toward the top end of the body in the slot provided in the outer wall, the arm 208 will wedge underneath the lower end of the spindle 76 and prevent it from rotating and changing the position of stop 70. This will ensure accurate repeatability of the device as it is used over and over again to transfer like quantities of liquid. Though the lock is very effective and easy to operate, it may be readily disengaged merely by sliding the lock slide downwardly by means of the finger grip 202 so that the arm 208 releases the spindle.

It will be appreciated that a certain amount of drag is imposed on the spindle by virtue of the contact of stop 70 carried by the spindle with the shoulder 94 at the upper end of the pipetter piston. That drag is sufficient to prevent the spindle from spinning freely on the adjusting screw. If a major change is to be made in the setting of the stop requiring that the spindle be rotated through many revolutions on the screw, the operator may eliminate the drag by slightly depressing the button 58 to separate the pipetter piston from the stop. The spindle may then very easily and quickly be spun through a substantial number of turns to make a gross adjustment.

Another advantage of the present invention is the reduction in the device of screw machined parts. All but a few of the parts of the device may be injection molded of a suitable plastic material. This mode of construction is reflected in reduced manufacturing costs for the device. Manufacturing costs are also minimized by the presence of only a few ultrasonically welded parts. In the construction of the pipetter described, only two ultrasonic welds are included, namely, at the attachment of the cap 22 to the body 20 and at the connection of the spindle cap 74 to the spindle 76.

Another advantage of the present invention is the ease with which the device may be taken apart for cleaning or sterilization. Merely by removing retaining nut 180 which connects the end of the rod 152 to the stripper 181, the stripper may be removed from the assembly so as to expose the full length of the tip holder 26 and the coupling which joins the tip holder to the adjusting screw 48 and body 20. More particularly, removal of the stripper exposes the locknut 32 which may then be turned so as to free the flange 36 of the tip holder. And with the tip holder removed, the retainer 44 may be removed, which will allow the piston 50 to be withdrawn. This is particularly convenient for the user who may wish to autoclave the piston 50 if, for example, fluid has accidentally entered the passage 60 in the tip holder from the passage 61 in the tip T. By removing the blow-out spring retainer 120 from the adjusting screw 48 and the plunger button 58 from the stem 56 of the guide rod 52, the blow-out spring 114, washer 82 and guide rod 52 may also be withdrawn from the body 20 through its lower end. The device may be further disassembled by squeezing the fingers 219 of the split adjusting screw 48 together to release the ears 220 from the openings 222.

Having described this invention in detail, those skilled in the art will appreciate that numerous modifications may be made thereof without departing from the spirit of this invention. Therefore, it is not intended that the scope of this invention be limited to the single embodiment illustrated and described. Rather, it is intended that the scope of this invention be determined by the appended claims and their equivalents.

What is claimed is:

1. A pipetter comprising an elongated body with upper and lower ends and having a chamber therein, an adjusting screw having an axial opening extending therethrough and in fixed relation to the body in the chamber during adjustment, said adjusting screw being externally threaded, a tip holder attached to the lower end of the body and having an opening therethrough axially aligned with the opening in the adjusting screw, said tip holder having a lower end for engaging and carrying removable tips, a pipetter piston with upper and lower ends mounted for axial motion in the adjusting screw opening and extending out the lower end of the body and into the tip holder opening, a rotatable, tubular spindle mounted in the chamber, extending over said adjusting screw and having internal threads which are threaded onto the external threads of the adjusting screw, a first stop carried by the spindle and movable therewith relative to the adjusting screw for limiting the upward travel of the pipetter piston in the openings, a second stop mounted in the body in the path of the pipetter piston for resisting movement of said piston in a downward direction beyond a preselected position, a thumb button on the upper end of the pipetter piston above the body and positioned to be engaged so as to actuate the piston, an elongated stripper surrounding a portion of the tip holder and movable axially thereon for removing a tip mounted on the lower end of the tip holder, an actuating rod mounted in the body and attached to the stripper for imparting axial motion to the stripper parallel to the piston axis so as to operate the stripper, and a thumb button attached to the rod above the upper end of the body.

2. A pipetter as defined in claim 1 wherein a first spring is mounted in the body and engages the pipetter piston for biasing said piston toward the first stop, and a second spring is mounted in the body and engages the second stop for yieldably holding the second stop in the preselected position but allowing the piston to move beyond that position.

3. A pipetter as defined in claim 2 wherein manually operable means are mounted in the body for releasably engaging the spindle for preventing the spindle from rotating.

4. A pipetter as defined in claim 2 wherein the adjusting screw is constructed to be compressible radially for insertion into the body, and means are removably mounted in the adjusting screw to prevent the screw from being compressed radially after the adjusting screw is inserted in the body.

5. A pipetter as defined in claim 1 wherein the actuating rod is removably coupled to the stripper outside the body.

6. A pipetter as defined in claim 1 wherein manually operable means are mounted in the body for releasably engaging the spindle for preventing the spindle from rotating.

7. A pipetter as defined in claim 1 wherein a window is provided on the body through which a portion of the spindle is viewable, and calibrations are carried by said viewable portion of the spindle for indicating the position of the first stop.

8. A pipetter as defined in claim 1 wherein a window is provided in the body through which the spindle is engageable for rotation on the adjusting screw.

9. A pipetter as defined in claim 1 wherein the adjusting screw is constructed to be compressible radially for insertion into the body, and means are removably mounted in the adjusting screw to prevent the screw from being compressed radially after the adjusting screw is inserted in the body.

10. A pipetter as defined in claim 9 wherein a pair of openings are provided in the body and a pair of ears are carried by the adjusting screw, said pair of ears engaging the openings when the screw is not compressed so as to position the screw in the body.

11. A pipetter comprising an elongated body with upper and lower ends and having a chamber therein, an adjusting screw having an axial opening extending therethrough and mounted in the chamber, said adjusting screw being externally threaded, a tip holder attached to the lower end of the body and having an opening therethrough axially aligned with the opening in the adjusting screw, said tip holder having a lower end for engaging and carrying removable tips, a pipetter piston with upper and lower ends mounted for axial motion in the adjusting screw opening and extending out the lower end of the body and into the tip holder opening, a spindle mounted in the chamber and threaded onto the external threads of the adjusting screw, a first stop carried by the spindle and movable therewith on the adjusting screw for limiting the upward travel of the pipetter piston in the openings, a second stop mounted in the body in the path of the pipetter piston for resisting movement of said piston in a downward direction beyond a preselected position, a thumb button on the upper end of the pipetter piston above the body and positioned to be engaged so as to actuate the piston, an elongated stripper surrounding a portion of the tip holder and movable axially thereon for removing a tip mounted on the lower end of the tip holder, an actuating rod mounted in the body and attached to the stripper for imparting axial motion to the stripper parallel to the piston axis so as to operate the stripper, a thumb button attached to the rod above the upper end of the body, and a coupling removably connecting the tip holder to the adjusting screw, the stripper enclosing the coupling.

12. A pipetter as defined in claim 11 wherein the actuating rod is removably coupled to the stripper outside the body.

13. A pipetter comprising an elongated body with upper and lower ends and having a chamber therein, an adjusting screw having an axial opening extending therethrough and in fixed relation to the body in the chamber during adjustment, said adjusting screw being externally threaded, a tip holder attached to the lower end of the body and having an opening therethrough axially aligned with the opening in the adjusting screw, a pipetter piston mounted for axial motion in the adjusting screw opening and extending out of the lower end of the body and into the tip holder opening, a rotatable, tubular spindle mounted in the body, extending over said adjusting screw and having internal threads which are threaded onto the external threads of the adjusting screw, a first stop carried by the spindle and movable therewith on the adjusting screw for limiting the upward travel of the pipetter piston in the openings, and means on the body engaging the spindle for releasably locking the spindle against rotation.

14. A pipetter comprising an elongated body with upper and lower ends and having a chamber therein, an adjusting screw having an axial opening extending therethrough and mounted in the body, said adjusting screw being externally threaded, a tip holder attached to the lower end of the body and having an opening therethrough axially aligned with the opening in the adjusting screw, a pipetter piston mounted for axial motion in the adjusting screw opening and extending out of the lower end of the body and into the tip holder opening, a spindle mounted in the body and threaded onto the external threads of the adjusting screw, a first stop carried by the spindle and movable therewith on the adjusting screw for limiting the upward travel of the pipetter piston in the openings, and a slide which frictionally engages the spindle for releasably locking the spindle so as to prevent rotation thereof.

15. A pipetter comprising an elongated body with upper and lower ends and having a chamber therein, an adjusting screw having an axial opening extending therethrough and mounted in the chamber, said adjusting screw being externally threaded and is constructed to be compressible radially for insertion into the body, a tip holder attached to the lower end of the body and having an opening therethrough axially aligned with the opening in the adjusting screw, said tip holder having a lower end for engaging and carrying removable tips, a pipetter piston with upper and lower ends mounted for axial motion in the adjusting screw opening and extending out the lower end of the body and into the tip holder opening, a spindle mounted in the chamber and threaded onto the external threads of the adjusting screw, a first stop carried by the spindle and movable therewith on the adjusting screw for limiting the upward travel of the pipetter piston in the openings, a second stop mounted in the body in the path of the pipetter piston for resisting movement of said piston in a downward direction beyond a preselected position, a thumb button on the upper end of the pipetter piston above the body and positioned to be engaged so as to actuate the piston, an elongated stripper surrounding a portion of the tip holder and movable axially thereon for removing a tip mounted on the lower end of the tip holder, an actuating rod mounted in the body and attached to the stripper for imparting axial motion to the stripper parallel to the piston axis so as to operate the stripper, a thumb button attached to the rod above the upper end of the body, a first spring mounted in the body and engaging the pipetter piston for biasing said piston toward the first stop, a second spring mounted in the body and engaging the second stop for yieldably holding the second stop in the preselected position but allowing the piston to move beyond that position, and means removably mounted in the adjusting screw to prevent the screw from being compressed radially after the adjusting screw is inserted into the body and to retain the second spring in position in the body.

16. A pipetter comprising an elongated body having upper and lower ends, a chamber extending longitudinally in the body and open at the lower end of the body, an adjusting screw mounted in the chamber and having an axial opening extending therethrough and insertable into the chamber through the open lower end thereof, a pipetter piston mounted for axial movement in the opening of the adjusting screw, a spindle rotatably mounted on the adjusting screw and carrying a first stop for limiting the upward travel of the pipetter piston in the opening of the screw, a split in the end of the adjusting screw nearer to the lower end thereof enabling said lower end to be compressed to insert the screw in the body, a first spring mounted in the screw opening and surrounding the pipetter piston for biasing the piston toward the firs stop, a second stop mounted in the opening of the screw and providing a yieldable stop limiting the downward travel of the piston in said opening, a blow-out spring mounted in the opening and engaging the second stop to yieldably hold the stop in a prescribed position, and a retainer disposed in the lower end of the screw for preventing the screw from being compressed and for holding the blow-out spring in the body.

17. A pipetter as defined in claim 16 wherein a tip holder is mounted on the lower end of the body, a stripper is mounted on the holder for removing tips carried by the holder, and an actuator is mounted on the body and connected to the stripper for operating the stripper.

18. A pipetter as defined in claim 17 wherein finger actuated buttons are carried by the actuator for the stripper and by the pipetter piston at the upper end of the body.

19. A pipetter comprising:

an elongated tubular body having an axis and a cylinder defining a discharge volume;

a tubular adjusting screw mounted coaxially and in fixed relation to the body during adjustment, said adjusting screw having an external screw thread on a portion thereof;

a manually-rotatable, tubular spindle fitting over said adjusting screw and having an internal screw thread which mates with said adjusting screw external screw thread so that said spindle can be adjusted axially with respect to said adjusting screw;

a piston extending through said adjusting screw and said spindle into said cylinder, said piston being axially movable towards said spindle during an intake stroke and axially movable towards said adjusting screw during a discharge stroke; and a stop connected to said spindle for limiting the axial movement of said piston during said intake stroke.

20. A pipetter according to claim 19 further comprising an axial scale on an unthreaded portion of said adjusting screw and a circular scale on an end of said spindle which fits over said adjusting screw, said circular scale cooperating with said axial scale so that said spindle is repeatably adjustable relative to said adjusting screw in fractional screw thread increments.

21. A pipetter according to claim 20 wherein said body has a window therein so that said axial scale and said circular scale are viewable.

22. A pipetter according to claim 21 wherein said spindle is engageable through said window for manual rotation.

23. A pipetter according to claim 19 wherein said piston has a radial shoulder contained within said spindle and said stop comprises a cap connected on one spindle end, said cap having a hole therethrough and said piston extending through said hole so that said shoulder contacts said cap and limits movement of said piston during said intake stroke.

24. A pipetter according to claim 19 further comprising a compression coil spring fitting over said piston and located between said piston and said adjusting screw, said spring urging said piston towards said spindle.

25. A pipetter according to claim 19 wherein said adjusting screw is removably attached to said body by means of a plurality of flexible ears, which ears fit into slots in said body.

26. A pipetter comprising:

an elongated body with upper and lower ends and having a chamber therein, an adjusting screw having an axial opening extending therethrough, a rotatable spindle mounted in the chamber, extending over said adjusting screw, means for varying the amount of fluid contained in the pipetter, said spindle and said adjusting screw in part forming a micrometer, having a vertical scale and a linear scale, and means forming an aperture in said body for viewing said micrometer.

* * * * *